US009125780B2

(12) United States Patent
Matsubara et al.

(10) Patent No.: US 9,125,780 B2
(45) Date of Patent: Sep. 8, 2015

(54) INFANT INCUBATOR

(71) Applicant: ATOM MEDICAL CORPORATION, Tokyo (JP)

(72) Inventors: Kazuo Matsubara, Tokyo (JP); Terumi Matsubara, Saitama (JP); Hidetoshi Sato, Saitama (JP); Kenji Kobayashi, Saitama (JP); Keisuke Wakabayashi, Saitama (JP)

(73) Assignee: ATOM MEDICAL CORPORATION, Tokyo (JP)

( * ) Notice: Subject to any disclaimer, the term of this patent is extended or adjusted under 35 U.S.C. 154(b) by 143 days.

(21) Appl. No.: 13/894,900

(22) Filed: May 15, 2013

(65) Prior Publication Data

US 2013/0310635 A1 Nov. 21, 2013

(30) Foreign Application Priority Data

May 18, 2012 (JP) ..... 2012-114351

(51) Int. Cl.
*A61G 11/00* (2006.01)

(52) U.S. Cl.
CPC ..... *A61G 11/003* (2013.01); *A61G 11/002* (2013.01); *A61G 11/006* (2013.01); *A61G 11/009* (2013.01)

(58) Field of Classification Search
CPC . A61G 11/002; A61G 11/003; A61G 11/006; A61G 11/009; A61G 11/00
USPC ..... 600/22
See application file for complete search history.

(56) References Cited

U.S. PATENT DOCUMENTS 6,245,010 B1 * 6/2001 Jones ..... 600/22
2010/0081859 A1 * 4/2010 Matsubara et al. ..... 600/22

FOREIGN PATENT DOCUMENTS

JP 10-165461 A 6/1998
JP 2001-070368 A 3/2001

* cited by examiner

*Primary Examiner* — Christine H Matthews
(74) *Attorney, Agent, or Firm* — Arent Fox LLP

(57) ABSTRACT

An infant incubator including: an infant chamber in which an infant is placed; an air-supply passage for supplying supply-air to the infant chamber; and a heater equipment for heating the supply-air having a mount base which is mounted in the air-supply passage and a heater which is held to the mount base rotatably, wherein the heater has: a support part provided at a base end of the heater and supported by the mount base rotatably; and a heating part provided at a top end of the heater and heating the supply-air, and the heating part is formed by winding a heating-wire into a coil-shape and disposed so that an axial direction of the coil-shape is orthogonal to a flow direction of the supply-air passing through the air-supply passage.

4 Claims, 11 Drawing Sheets

INFANT INCUBATOR

BACKGROUND OF THE INVENTION

1. Field of the Invention

The present invention relates to an infant incubator having a function of controlling temperature environment in an infant chamber for holding an infant.

Priority is claimed on Japanese Patent Application No. 2012-114351, filed May 18, 2012, the content of which is incorporated herein by reference.

2. Description of the Related art

In order to protect and grow an infant in most appropriate environment dividing from external air, in an infant incubator, an infant chamber is ventilated by an air-conditioning equipment filtering the external air so as to absorb into the infant incubator, and air is circulated as heated by heater equipment so as to maintain temperature environment in the infant chamber. Action of the air-conditioning equipment should be quiet in order not to stress the infant.

In the infant incubator, in order to maintain the inside of the infant chamber hygienically, the heater equipment should be also maintained hygienically not only the inside of the infant chamber. Therefore, it is necessary to clean and disinfect the inside of the infant chamber and also the heater equipment. However, since the heater equipment is attached to the infant incubator, the structure in the infant incubator is complicated. Therefore, it is hard to clean and disinfect, so that there is a burden of cleaning and disinfection on an operator.

In Japanese Unexamined Patent Application, First Publication No. H10-165461 (hereinafter, "Patent Document 1"), unitized heater equipment (i.e., a heater assembly) is suggested so as to detach the heater equipment easily from the infant incubator. However, even though the heater equipment is unitized as disclosed in the Patent Document 1, it is necessary to clean and disinfect in a state in which the heater equipment is detached. Therefore, the burden on the operator is still big.

Consequently, in Japanese Unexamined Patent Application, First Publication No. 2001-70368 (hereinafter, "Patent Document 2"), an apparatus in which a heater formed by wounding heater wires into a coiled-state is rotatably held with respect to a bottom plate at a base-end portion thereof is suggested.

SUMMARY OF THE INVENTION

Problems to be Solved by the Invention

In the heater equipment of the Patent Document 2, a heater can be moved by rotating from an operating position to a non-operating position, so that the inside of the infant incubator can be easily cleaned and disinfected without detaching the heater equipment. However, further improvement in workability is required for reducing the burden on the operator. Moreover, silence is required so as to prevent an infant from suffering stress by an operation of air-conditioning equipment.

Means for Solving the Problem

The present invention is achieved in consideration of the above circumstances, and has an object to provide an infant incubator in which cleaning and disinfection can be easily operated for maintain an inside of an infant chamber hygienically, workability can be improved, and noise reduction can be realized.

An infant incubator according to the present invention includes: an infant chamber in which an infant is placed; an air-supply passage for supplying supply-air to the infant chamber; and a heater equipment for heating the supply-air having a mount base which is mounted in the air-supply passage and a heater which is held to the mount base rotatably, wherein the heater has: a support part provided at a base end of the heater and supported by the mount base rotatably; and a heating part provided at a top end of the heater and heating the supply-air, and the heating part is formed by winding a heating-wire into a coil-shape and disposed so that an axial direction of the coil-shape is orthogonal to a flow direction of the supply-air passing through the air-supply passage.

Since the heater is supported at the base end thereof rotatably by the mount base, the heater of the heater equipment can be disposed out of the air-supply passage when cleaning and disinfecting (i.e., in a non-operating state) by rotating the heating part from an operating-state in which the heating part is disposed in the air-supply passage. Therefore, even though the heater equipment is mounted on the infant incubator, cleaning and disinfection of the inside of the air-supply passage and the heater equipment can be easily operated.

Furthermore, the heating part of the heater is disposed so that the axial direction of the coil of the heating-wire is orthogonal to the flow direction of the supply-air. Therefore, a surface area of a part facing the flow direction of the supply-air can be reduced. Accordingly, the supply-air can flow through gaps between the heating-wire, so that a resistance can be reduced and low noise can be realized.

In the infant incubator of the present invention, it is preferable that the coil-shape of the heating-wire of the heating part be formed to have an oblong-shape in which a length along the flow direction of the supply-air is large.

Since the surface area of the part facing the flow direction of the supply-air in the heating part is reduced, and on the other hand, a surface area of a part along the flow direction of the supply-air is increased, the low noise can be realized and a warming performance can be sufficiently maintained.

In the infant incubator according to the present invention, it is preferable that the heater be disposed so that the support part is positioned downstream in the supply-air; and the heating part is positioned upstream in the supply-air.

Since an arc-shape portion of the coil-shape part of the heating-wire faces toward upstream, the convex outer surface of the arc-shape portion mostly receives the flow of the supply-air. Therefore, it is easier to operate the cleaning and disinfection in comparison with a case in which the supply-air flows through inside the coil-shape portion as the Patent Document 2. Moreover, since the support part of the heater and the mount base are disposed downstream, the flow of the supply-air is not disturbed, so that the noise can be further reduced.

Effects of the Invention

According to the infant incubator of the present invention, it is easy to clean and disinfect even though the heater equipment is attached to the infant incubator. Furthermore, since the heater is disposed along the flow of the supply-air so as not to prevent the flow of the supply-air, the noise can be reduced.

DETAILED DESCRIPTION OF THE INVENTION

Figure 1A:
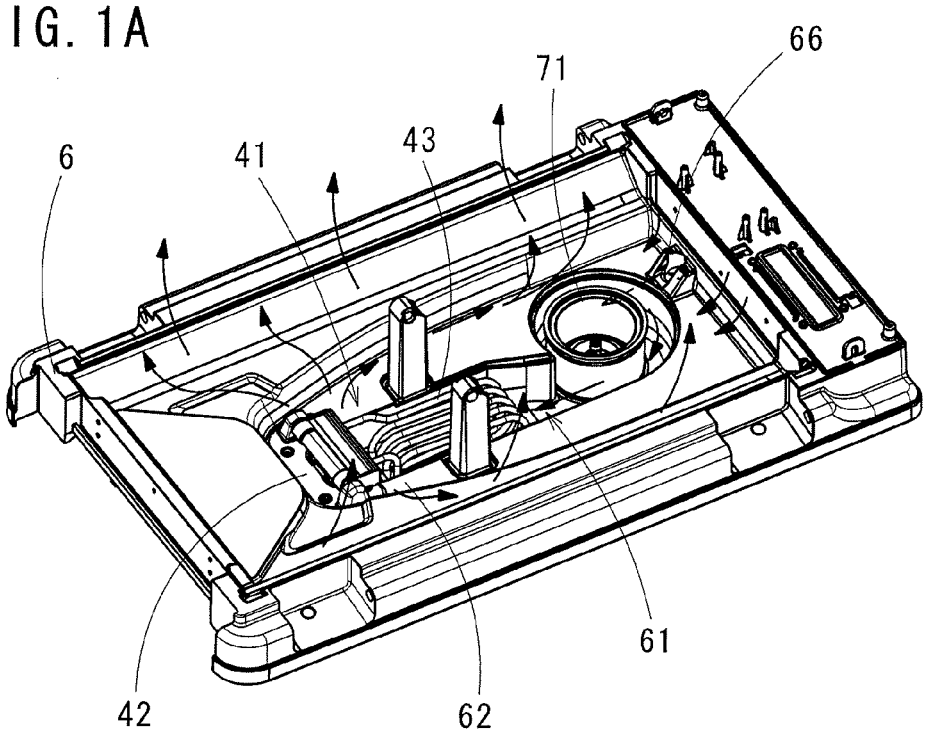
FIG. 1A is a perspective view showing a heater equipment in an embodiment of an infant incubator according to the present invention in a state in which an air-supply passage is exposed.

Below, an embodiment of an infant incubator according to the present invention will be described.

[Total Construction of an Infant Incubator]

As totally shown in FIGS. 7 to 10, an infant incubator 1 is provided with: a pedestal 3 which is movable by casters 2; a supporting post 4 which is vertically erected on the pedestal 3; a frame 5 which is provided at a top end of supporting post 4; a base table 6 which is set on the frame 5; a hood 8 which is provided on the base table 6 and surrounds an infant chamber 7; two guide posts 9 and 10 which are vertically provided at an end portion of the frame 5 and at both sides of the hood 8; a chamber heater 11 which is provided at a top end of one of the guide posts (i.e., the guide post 10); and a canopy 12 which is set on a top end of the other of the guide posts (i.e., the guide post 9) and composes a roof of the hood 8.

The supporting post 4 internally has a lift which moves the frame 5 up and down. A pedal 13 is provided at a side of the pedestal 3 for operating the lift.

The hood 8 is constructed substantially rectangular from: a floor plate 16 in which a bed 15 for laying an infant down is mounted; a left-side treatment-door 17 and a right-side treatment-door 18 which are disposed each at a left side and a right side of the infant; a foot-side treatment-door 19 which is disposed at a foot side of the infant; a head-side treatment-door 20 which is disposed at a head side of the infant; and the canopy 12 which closes a top of the infant chamber 7 which is surrounded by the left-side and right-side treatment-doors 17 and 18, the foot-side treatment-door 19 and the head-side treatment-door 20. The left-side treatment-door 17, the right-side treatment-door 18, the foot-side treatment-door 19, the head-side treatment-door 20 and the canopy 12 are substantially entirely formed from transparent resin, so that the infant in the infant chamber 7 can be checked with eyes from the outside.

Figure 11:
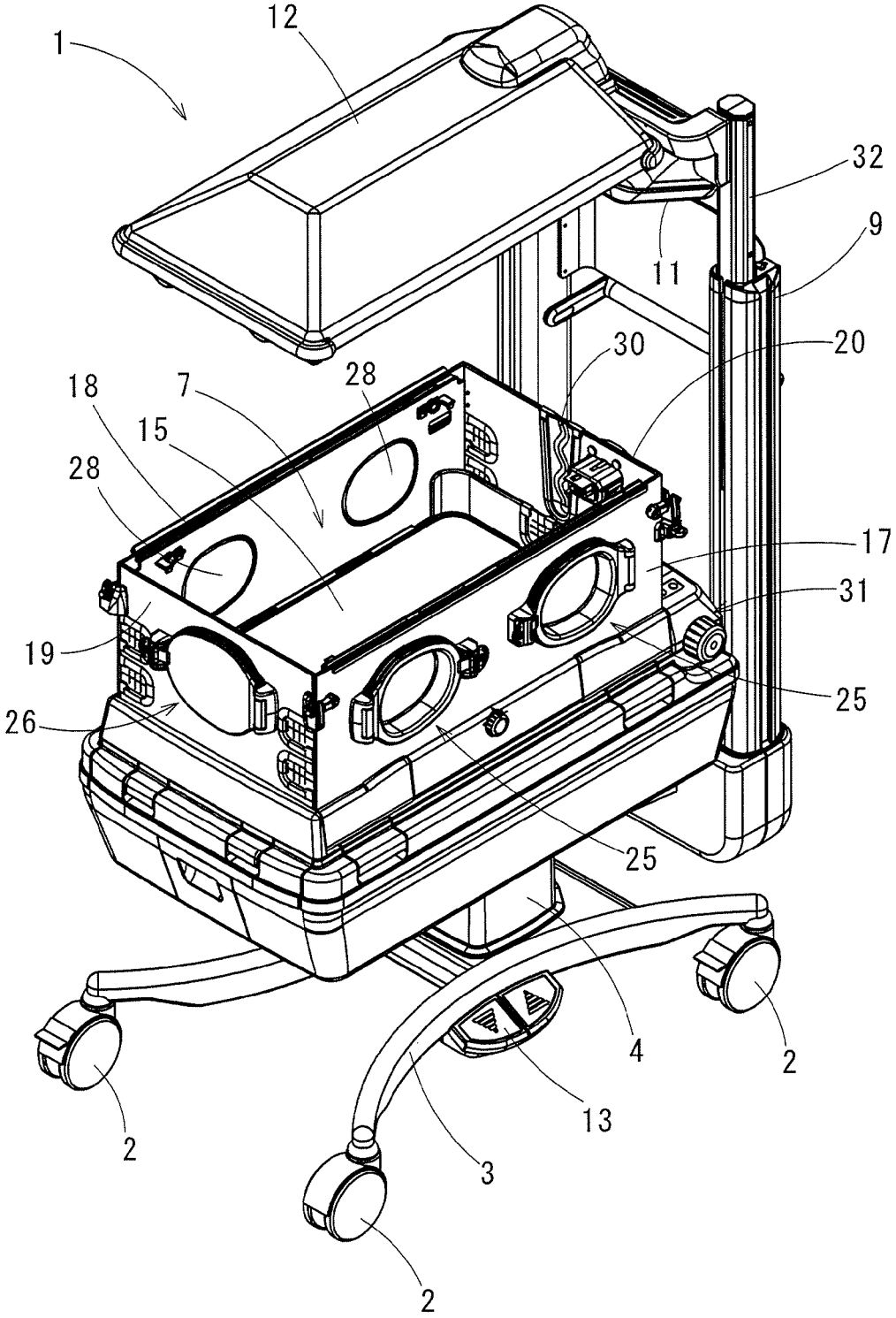
FIG. 11 is a perspective view showing the infant incubator in a state in which a canopy and a chamber heater are moved up from a state shown in FIG. 7.

FIGS. 7 to 10 show a state in which the hood 8 is closed by moving down the canopy 12, and FIG. 11 shows a state in which the top of the infant chamber 7 is open by moving up the canopy 12. Also, FIG. 11 shows a state in which the chamber heater 11 is moved up and the infant chamber 7 is heated.

As described above, the infant incubator 1 has both the functions of an enclosed incubator shown in FIGS. 7 to 10 and an open incubator shown in FIG. 11.

Figure 9:
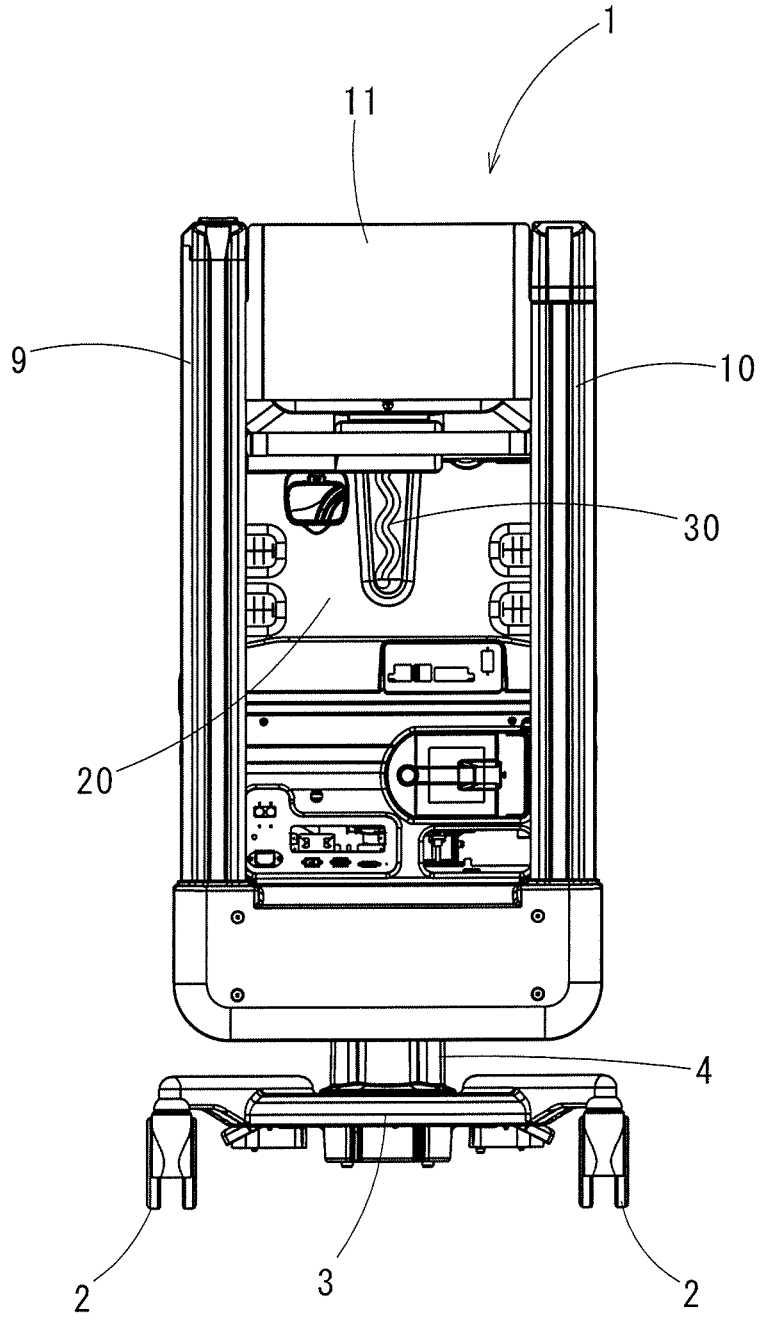
FIG. 9 is a right-side view with respect to FIG. 8.
Figure 10:
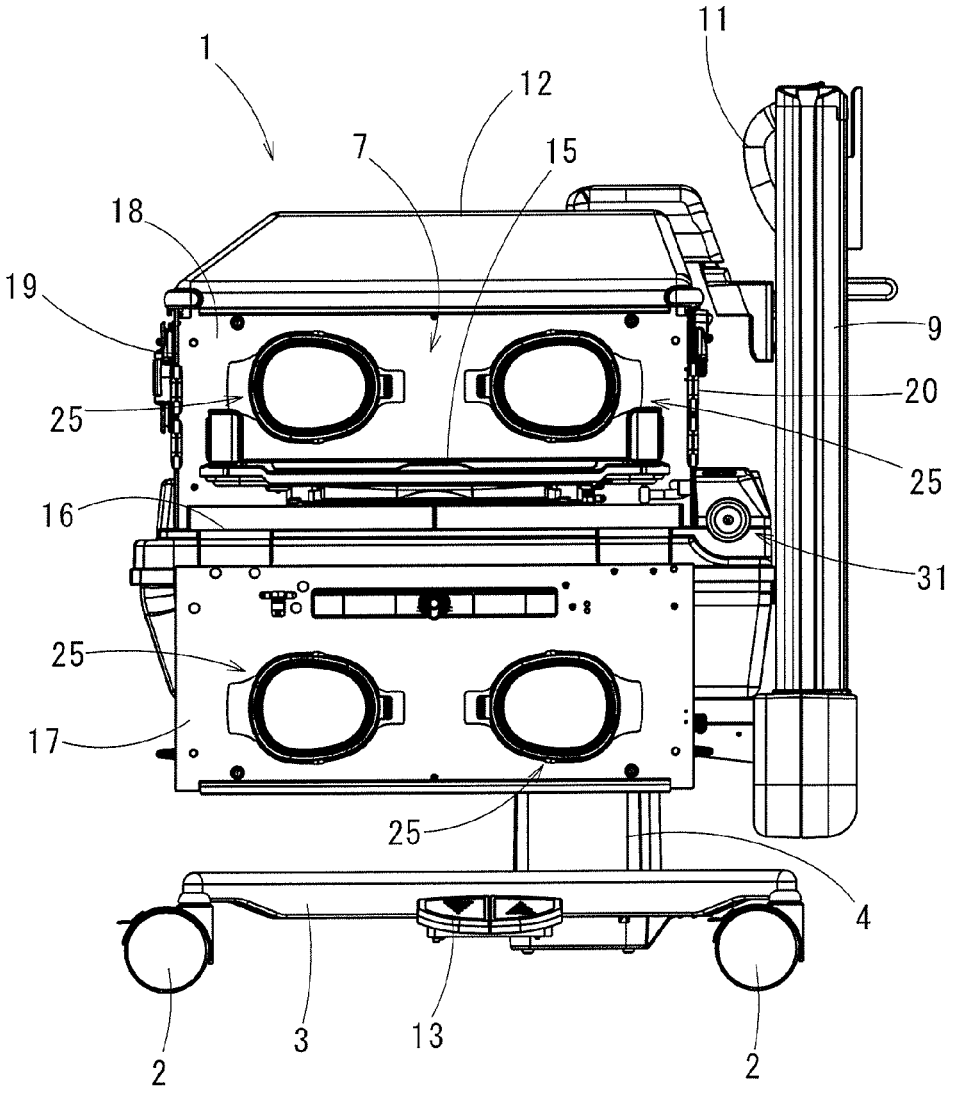
FIG. 10 is a front view showing the infant incubator in a state in which the left-side treatment-door is open from a state shown by FIG. 8.

Among the treatment-doors 17 to 20, the head-side treatment-door 20 is maintained in a vertical position erecting at the head side of the infant chamber 7. On the other hand, lower ends of the left-side and right-side treatment-doors 17, 18 and the foot-side treatment-door 19 are installed swingably around a horizontal shaft (not illustrated) with respect to the base table 6. In a case in which the infant incubator 1 is used as the enclosed incubator, the treatment-doors 17 to 19 are closed, and the left-side and right-side treatment-doors 17 and 18 can be open and closed for taking care of the infant. In FIG. 9, one side of the infant chamber 7 is open by turning the left-side treatment-door 17 in the enclosed mode. In a case in which the infant incubator 1 is used as the open incubator, three sides of the infant chamber 7, i.e., the left-side treatment-door 17, the right-side treatment-door 18 and the foot-side treatment-door 19 can be open and closed.

The left-side treatment-door 17 and the right-side treatment-door 18 have access-port units 25 each having an access port; and the foot-side treatment-door 19 has an access-port unit 26 having an access port. When the infant incubator 1 is used as the enclosed incubator, the access ports of the access-port units 25 and 26 can be open and closed while the treatment-doors 17 to 19 remain standing. Grommet members 30 having slits through which cables or tubes are inserted are attached to the head-side treatment-door 20.

On the floor plate 16 in the infant chamber 7, the bed 15 on which the infant is laid is provided. The bed 15 is swingably held at a center of a longitudinal direction by a horizontal shaft (not illustrated) and an end portion of the head side is held by a lift 31. By elevating the end portion which is held by the lift 31, the bed 15 can be maintained in a position which is inclined to the horizontal direction. The lift 31 is provided at an outside of the hood 8.

Figure 7:
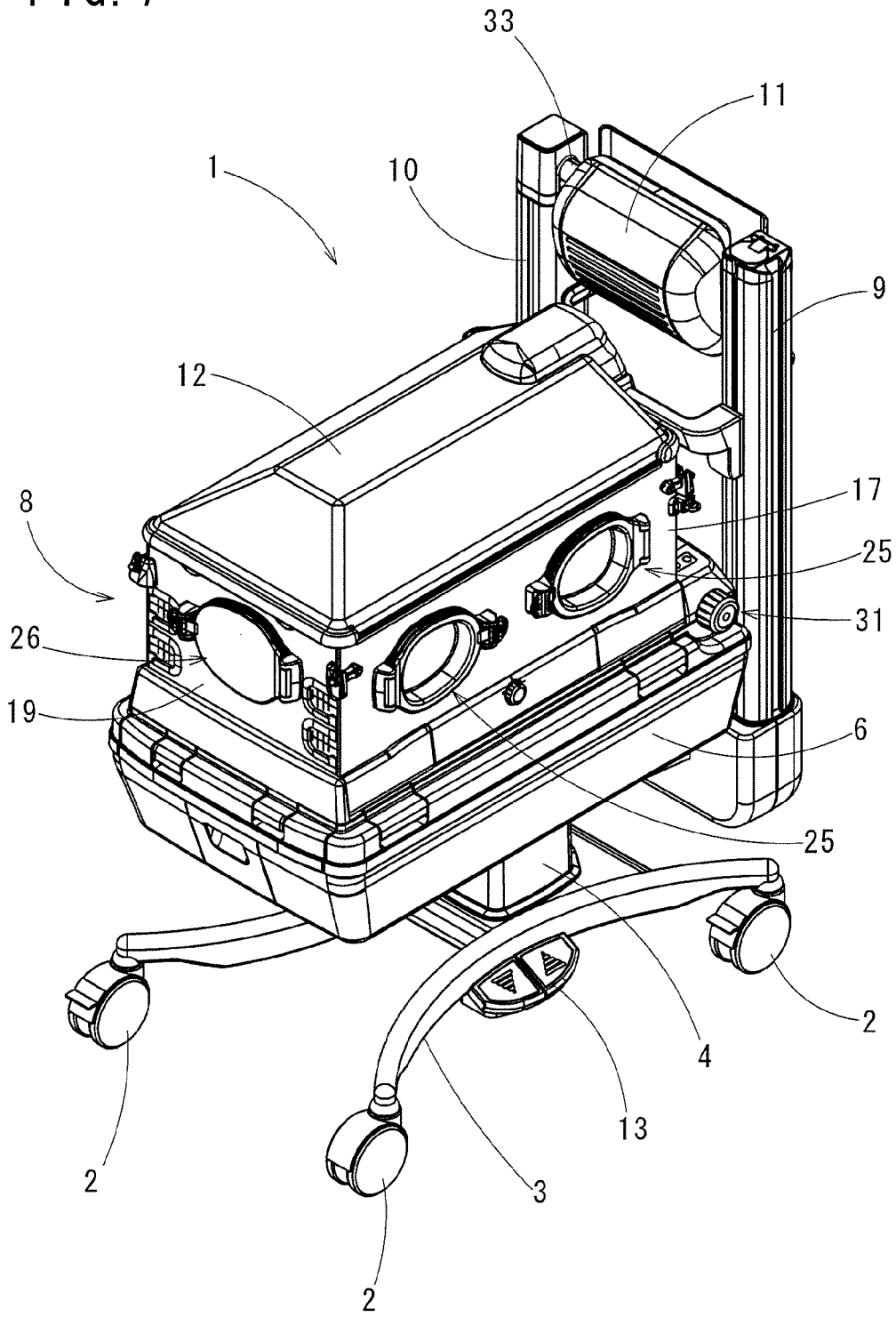
FIG. 7 is a perspective view showing the whole infant incubator.
Figure 8:
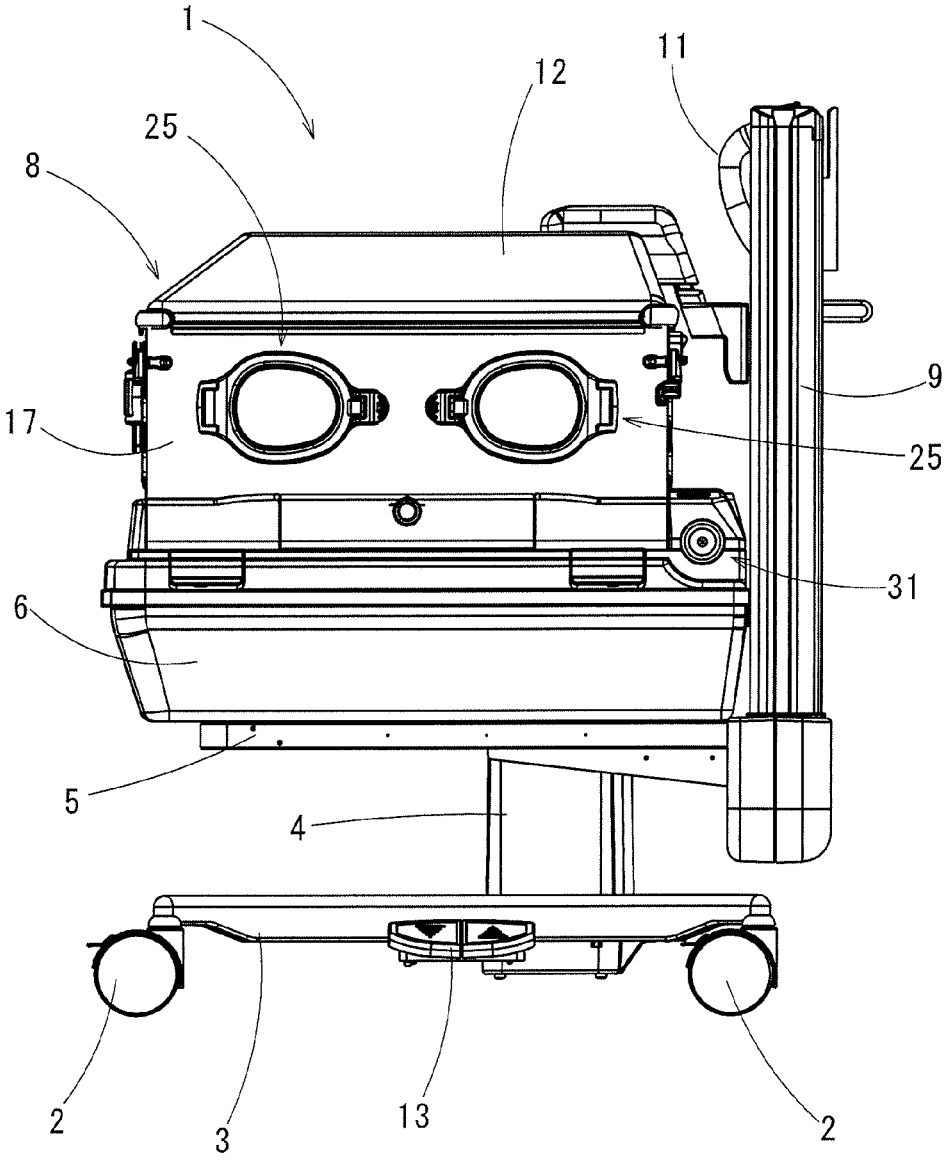
FIG. 8 is a front view showing a closed left-side treatment-door of the infant incubator.

The guide posts 9 and 10 each have a coaxial rod 32 and a lift which moves up and down the rod 32 therein. The canopy 12 is attached to an upper end of the rod 32 in the guide post 9, can close the infant chamber 7 at a down position thereof by being in contact with upper ends of the treatment-doors 17 to 20, and can retract from the treatment-doors 17 to 20 at an upper position thereof at an enough distance for treatments for the infant as shown in FIG. 11. The chamber heater 11 is attached to an upper end of a rod (not illustrated, but provided as the guide post 9 shown in FIG. 11) in the other guide post 10 rotatably around a horizontal shaft 33. The chamber heater 11 has: a folding position at a down position by folding vertically and substantially parallel to the guide post 10 as shown in FIG. 7 and so forth; and a heating position at an elevated position for supplying heat wave from above to the infant chamber 7 by raising with a predetermined angle with respect to the vertical direction.

[Construction of Heater Equipment]

Figure 1B:
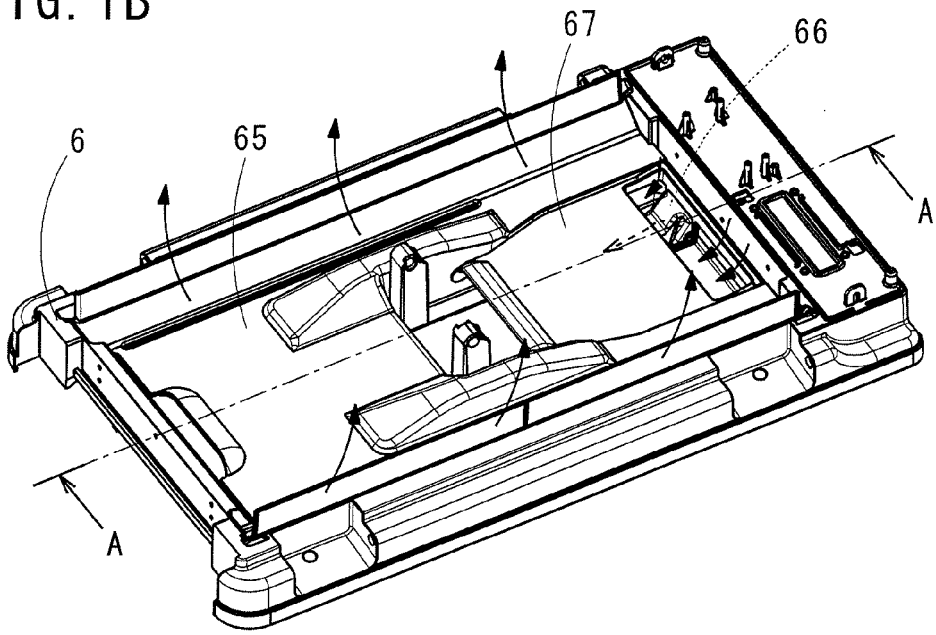
FIG. 1B is a perspective view showing the heater equipment of FIG. 1A in a state in which a middle flooring covers the air-supply passage.
Figure 2:
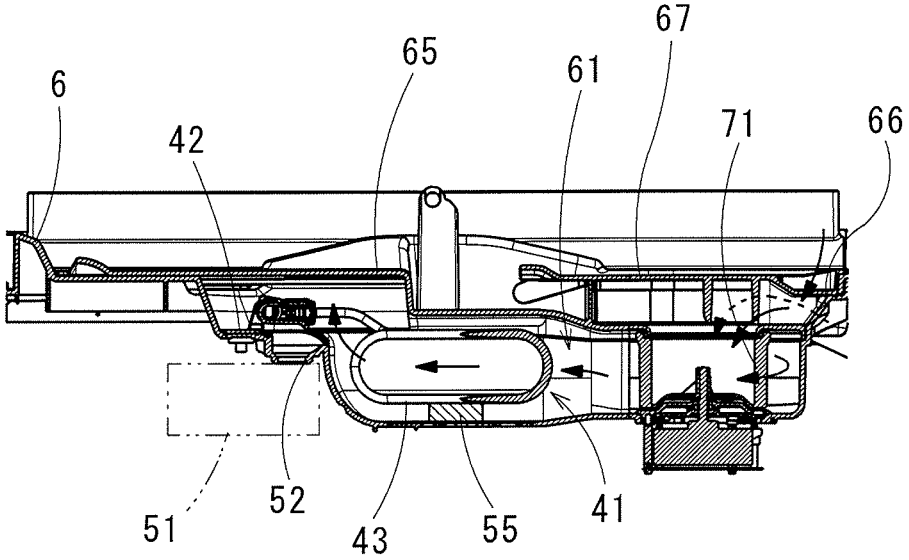
FIG. 2 is a cross-sectional view taken along the line A-A in FIG. 1B.
Figure 3:
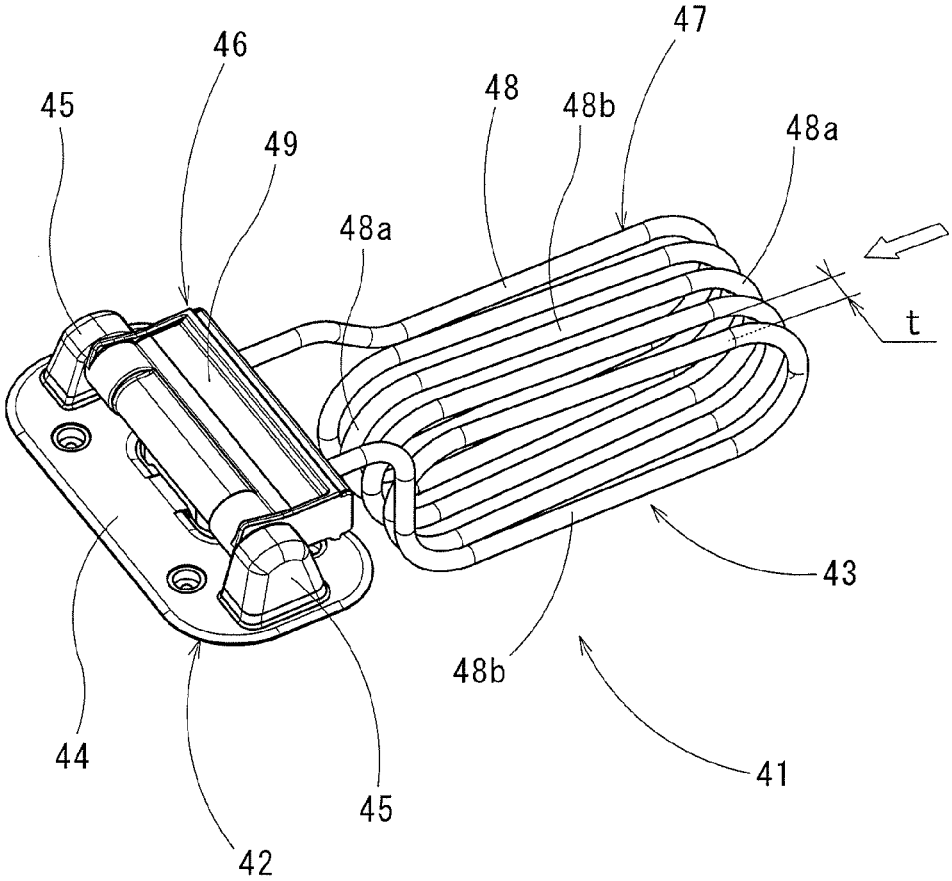
FIG. 3 is a perspective view showing a structure of the heater equipment.

FIG. 1 and FIG. 2 show heater equipment 41 mounted on the base table 6. The heater equipment 41 controls a temperature environment in the infant chamber 7 by warming supply-air to the infant chamber 7. FIG. 1A shows a state in which the heater equipment 41 is exposed by detaching a middle flooring 65 and a fan cover 67 shown in FIG. 1B so as to open an upper of an air-supply passage 61.

The air-supply passage 61 of the supply-air is, as shown in FIG. 1A, formed near a center of the base table 6 and lower than an upper surface 62 of the base table 6. The heater equipment 41 is disposed in the air-supply passage 61 of the supply-air, and warms the supply-air flowing in the air-supply passage 61 as shown by solid lines. In the air-supply passage 61, external air (shown by arrows with dotted lines in FIGS. 1A and 1B) taken from an air-inlet (not illustrated) through an inflow port 66 and flowing into the infant incubator 1 and circulated air from the infant chamber 7 (shown by continuous lines in FIGS. 1A and 1B) are mixed and supplied into the infant chamber 7 as the supply-air.

The heater equipment 41 is provided with a mount base 42 which is mounted on the upper surface 62 of the base table 6 and a heater 43 which is held to the mount base 42 rotatably.

Figure 5:
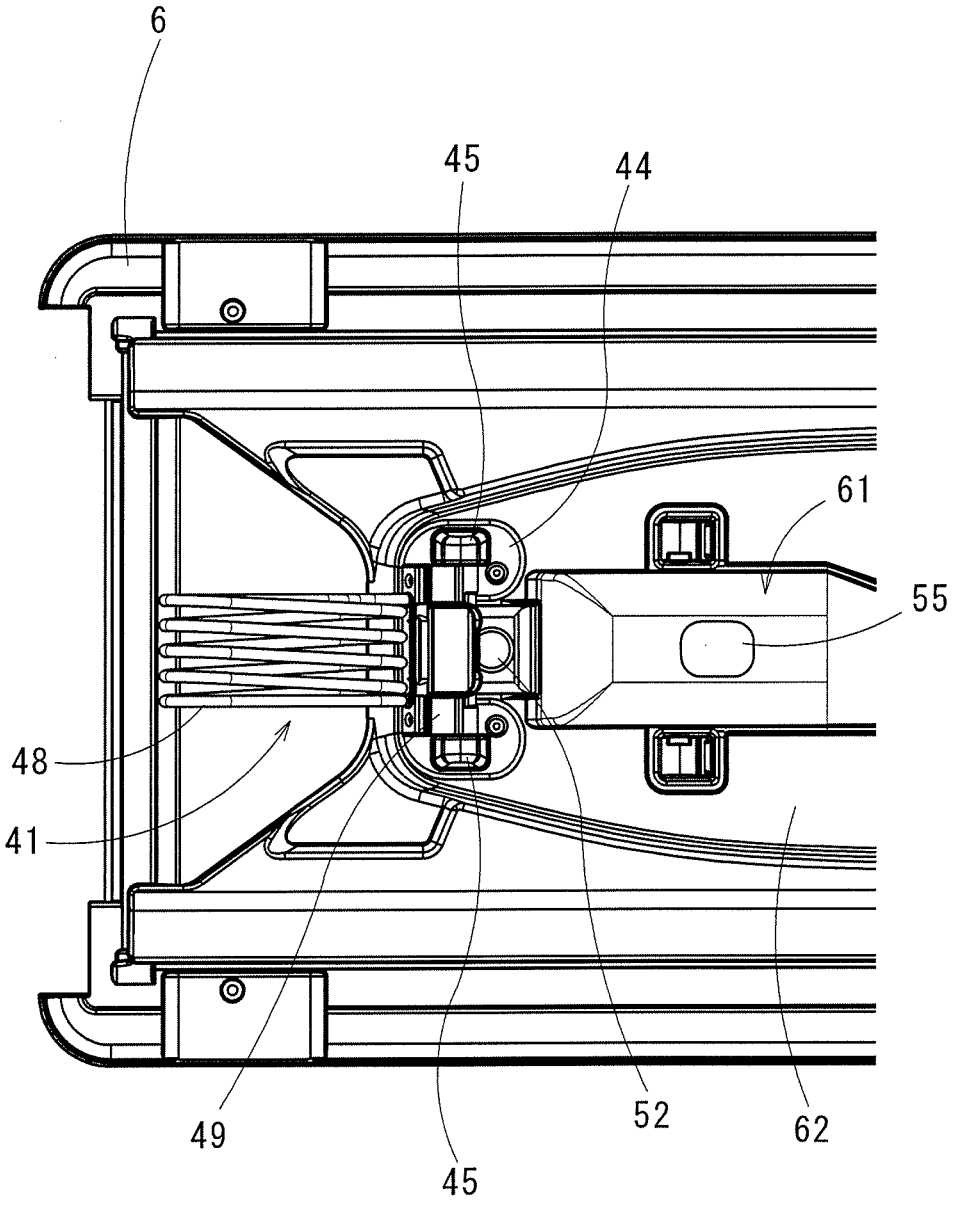
FIG. 5 is a top view taken along the line B in FIG. 4B showing the heater equipment in the state in which the heater equipment is not operated.

In the mount base 42, as shown in FIG. 5, a pair of bearing parts 45 are attached with gaskets to both sides of a base part 44 fixed on the upper surface 62 of the base table 6. The base part 44 has a void part between the bearing parts 45, so that a communication port 52 is arranged at the void part for bringing vapor discharged from a humidor tank 51 into the air-supply passage 61. Humidified air is generated by supplying the vapor into the air-supply passage 61 through the communication port 52, and supplied into the infant chamber 7.

When the upper surface 62 of the base table 6 is covered with the middle flooring 65, a clearance is formed between the upper surface 62 and the middle flooring 65. The supply-air passes through the air-supply passage 61, and then is blown to the left and right side of the infant chamber 7 as shown by the arrows with continuous lines in FIG. 1A. In the infant chamber 7, the left-side treatment-door 17 and the right-side treatment-door 18 each has a double walled structure of an inner wall and an outer wall. The supply-air is supplied into the infant chamber 7 by blowing the supply-air upward from the air-supply passage 61 into clearances between the inner walls and the outer walls.

The heater 43 has: a support part 46 provided at a base end of the heater 43 and supported by the mount base 42 rotatably; and a heating part 47 such as a sheathed heater or the like provided at a top end of the heater 43.

The heating part 47 is formed by winding a heating-wire 48 into a coil-shape with a certain clearance "t" (for example, a clearance of the same dimension as a diameter of the heating-wire 48). Both ends of the heating-wire 48 extend from the coil-shape part and are connected to the support part 46. The heating part 47 is disposed so that an axial direction of the coil-shape is orthogonal to a flow direction of the supply-air flowing through the air-supply passage 61. The coil-shape part of the heating part 47 is formed to have half-arc shape parts 48*a* at both the end parts. The half-arc shape parts 48*a* are connected by a linear intermediate part 48*b*. As a whole, the heating part 47 is formed to have an oblong-shape in which a length along the flow direction of the supply-air in the air-supply passage 61 is large.

In the support part 46 of the heater 43, a cover member 49 is attached at both the ends of the heating-wire 48 with gaskets. The support part 46 is rotatably held to the mount base 42 by the cover member 49. The heater 43 is disposed at a predetermined position in the air-supply passage 61 by being arranged to be in contact with an upper surface of a stopper 55 provided in the air-supply passage 61.

The heater 43 is disposed in the air-supply passage 61 so that the support part 46 is positioned downstream in the supply-air, and the heating part 47 is positioned upstream in the supply-air. A sirocco fan 71 is installed at a front position (i.e., upstream position) of the heater 43 so as to blow the supply-air from the heating part 47 side toward the support part 46 side in the heater 43.

Figure 4A:
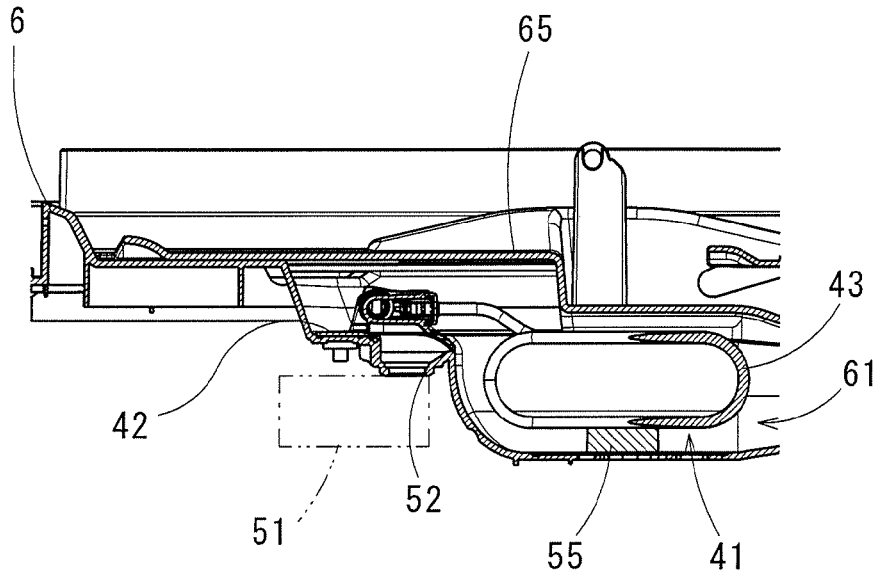
FIG. 4A is an enlarged sectional view showing a substantial part of the heater equipment in a state in which the heater equipment is operated.
Figure 4B:
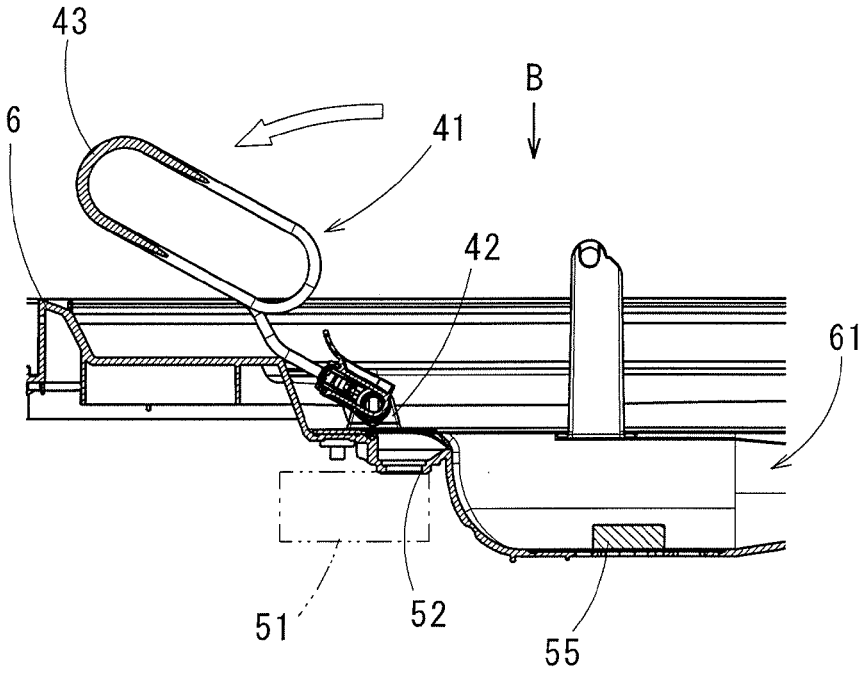
FIG. 4B is an enlarged sectional view showing the substantial part of the heater equipment in a state in which the heater equipment is not operated.

The mount base 42 of the heater equipment 41 is, as shown in FIG. 2, fixed downstream of the heater 43 in the flow of the supply-air. The heater 43 can be moved by rotating from an operating position being entered into the air-supply passage 61 (FIG. 4A) to a non-operating position being arranged outside the air-supply passage 61 (FIG. 4B).

As described above, since the support part 46 of the heater 43 is held rotatably to the mount base 42, the heating part 47 of the heater 43 can be positioned by rotating the heater 43 from inside the air-supplying passage 61 to outside the air-supply passage 61 for cleaning and disinfection (i.e., in the non-operating state). Therefore, even though the heater equipment 41 is attached to the infant incubator 1, it is easy to operate cleaning and disinfection of the inside of the air-supply passage 61 and the heater equipment 41.

Moreover, the heating part 47 of the heater 43 is arranged so that the axial direction of the coil-shape part of the heating-wire 48 is orthogonal to the flow direction of the supply-air; and the coil-shape part is formed to have the oblong-shape in which the length along the flow direction of the supply-air is large. Therefore, the supply-air can be flow through the clearance "t" between the heating-wire 48 formed into the coil-shape, so that a surface area of the heating wire 48 of a part facing the flow direction of the supply-air can be reduced.

Furthermore, the half-arc shape part 48*a* of the coil-shaped heating-wire 48 faces toward upstream, the convex outer surface of the half-arc shape part 48*a* mostly receives the flow of the supply-air. Therefore, a resistance with respect to the flow of the supply-air can be reduced and low noise can be realized. Additionally, since the heating-wire 48 is formed as the coil-shape with the clearance "t", it is easy to operate cleaning and disinfection. Moreover, since the oblong heating part 47 has the large surface area along the flow of the supply-air, warming performance can be maintained enough.

In heater 43 of the heater equipment 41, the support part 46 is disposed downstream and the heating part 47 is disposed upstream in the supply-air. Therefore, the flow of the supply-air is not disturbed by the support part 46 of the heater 43 and the mount base 42, and the low noise can be realized.

Figure 6:
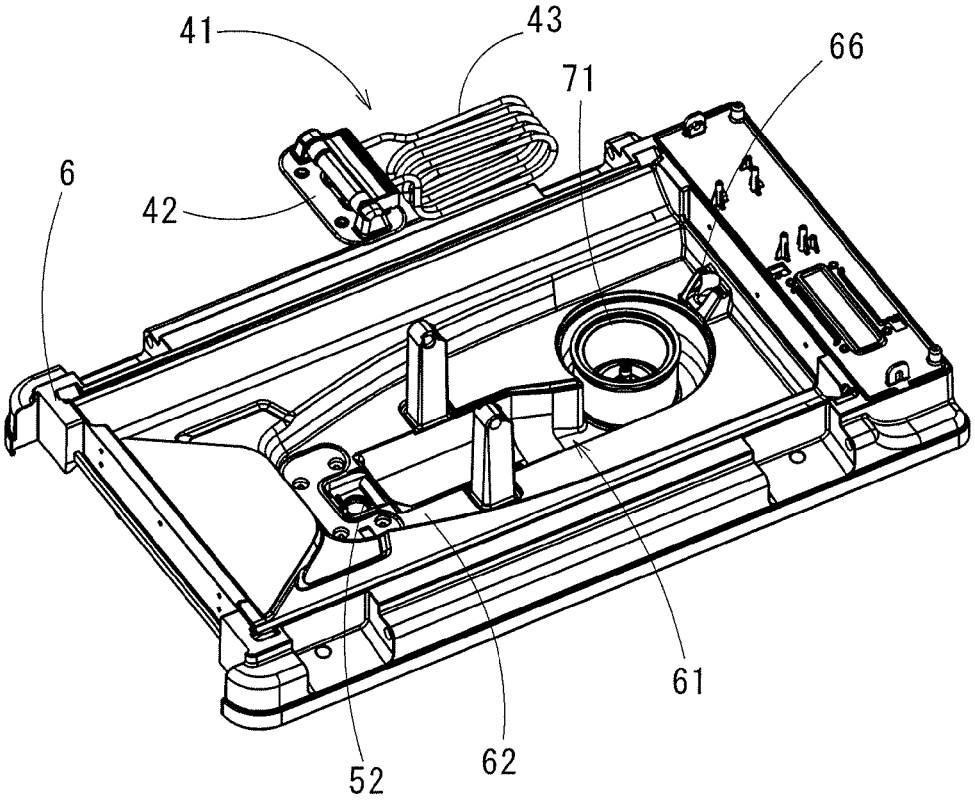
FIG. 6 is a perspective view showing the infant incubator in a state in which the heater equipment is detached.

Furthermore, the heater equipment 41 is attached to the base table 6 by the mount base 42. Therefore, when maintaining the heater equipment 41 or when it is necessary to exchange a unit of the heater equipment 41, as shown in FIG. 6, it is easy to detach the heater equipment 41 only by detaching the mount base 42, and also easy to attach the unit. As a result, workability can be improved.

The present invention is not limited to the above-described embodiments and various modifications may be made without departing from the scope of the present invention.

What is claimed is:

1. An infant incubator comprising:

an infant chamber configured to receive an infant;

an air-supply passage for supplying supply-air to the infant chamber, wherein the air-supply passage is formed by a passage through a portion of a base table; wherein the base table is arranged under the infant chamber; and a heater equipment, for heating the supply-air, having a mount base which is mounted in the air-supply passage and a heater which is held to the mount base rotatably, wherein the heater has: a support part provided at a base end of the heater and supported by the mount base rotatably; and a heating part provided at a top end of the heater and heating the supply-air, and the heating part is formed by winding a heating-wire into a coil-shape and disposed so that an axial direction of the coil-shape is orthogonal to a flow direction of the supply-air passing through the air-supply passage.

2. The infant incubator according to claim 1, wherein the coil-shape of the heating-wire of the heating part is formed to have an oblong-shape in which a length along the flow direction of the supply-air is large.

3. The infant incubator according to claim 1, wherein the heater is disposed so that the support part is positioned downstream in the supply-air; and the heating part is positioned upstream in the supply-air.

4. The infant incubator according to claim 1, further comprising:

a chamber heater above the infant chamber, wherein the heater equipment is disposed in the air-supply passage in the base table.

* * * * *